US012214922B2

(12) United States Patent
Schiekiera et al.

(10) Patent No.: US 12,214,922 B2
(45) Date of Patent: Feb. 4, 2025

(54) METHOD AND ARRANGEMENT FOR PACKAGING GROUPS OF CONTAINERS, SUCH AS BOTTLES, CANS, AND SIMILAR CONTAINERS, FOR CONTAINING BEVERAGES OR OTHER PRODUCTS

(71) Applicant: KHS GMBH, Dortmund (DE)

(72) Inventors: Dirk Schiekiera, Herdecke (DE); Sebastian Pieters, Kleve (DE)

(73) Assignee: KHS GmbH, Dortmund (DE)

( * ) Notice: Subject to any disclaimer, the term of this patent is extended or adjusted under 35 U.S.C. 154(b) by 178 days.

(21) Appl. No.: 17/577,130

(22) Filed: Jan. 17, 2022

(65) Prior Publication Data

US 2022/0135269 A1 May 5, 2022

Related U.S. Application Data

(63) Continuation-in-part of application No. PCT/EP2020/068205, filed on Jun. 29, 2020.

(30) Foreign Application Priority Data

Jul. 17, 2019 (DE) ..... 102019119399.0

(51) Int. Cl.

| | |
|---|---|
| ***B65D 71/00*** | (2006.01) |
| ***B65B 17/02*** | (2006.01) |
| ***B65B 61/14*** | (2006.01) |
| ***B65D 71/52*** | (2006.01) |
| ***B65D 71/56*** | (2006.01) |

(52) U.S. Cl.

CPC ..... *B65B 61/14* (2013.01); *B65B 17/02* (2013.01); *B65D 71/0003* (2013.01); *B65D 71/0018* (2013.01); *B65D 2571/0045* (2013.01)

(58) Field of Classification Search

CPC ..... B65D 71/0003; B65D 2571/0045; B65D 71/0018

USPC ..... 206/150, 427, 428, 161

See application file for complete search history.

(56) References Cited

U.S. PATENT DOCUMENTS

| | | | | |
|---|---|---|---|---|
| 2,533,997 A | | 12/1950 | Cochrane | |
| 2,677,460 A | | 5/1954 | Johnson et al. | |
| 2,748,978 A | * | 6/1956 | Hennessey | B65D 5/46064 229/117.22 |
| 3,106,289 A | * | 10/1963 | Chatten | B65D 73/0028 206/162 |

(Continued)

FOREIGN PATENT DOCUMENTS

| | | |
|---|---|---|
| CA | 2330220 A1 | 7/2002 |
| CN | 1176923 A | 3/1998 |

(Continued)

*Primary Examiner* — Steven A. Reynolds

(74) *Attorney, Agent, or Firm* — Laurence A. Greenberg; Werner H. Stemer; Ralph E. Locher

(57) ABSTRACT

A beverage container handling machine, such as a beverage container filling machine or a beverage container closing machine, is used to handle beverage containers, such as bottles, cans, and similar containers, which containers are configured to hold or contain a beverage, such as water, soft drinks, beer, wine, and juices, or a similar product for transport and consumption by consumers of beverages and similar products. Container packages, such as multipacks, are used for transporting groups of beverage containers, such as bottles, cans, and similar containers, for containing beverages or other products.

17 Claims, 12 Drawing Sheets

(56) References Cited

U.S. PATENT DOCUMENTS

| | | | | | |
|---|---|---|---|---|---|
| 3,261,498 | A | | 7/1966 | Erickson | |
| 3,693,830 | A | | 9/1972 | Oglesbee | |
| 3,759,378 | A | | 9/1973 | Werth | |
| 4,471,870 | A | * | 9/1984 | Uhlig | B65D 71/38 206/427 |
| 4,564,106 | A | * | 1/1986 | Shilcock | B65D 71/50 294/87.2 |
| 5,765,684 | A | * | 6/1998 | Van Dore | B65D 25/108 206/427 |
| 5,876,081 | A | * | 3/1999 | Melody | B65D 5/46032 D9/434 |
| 6,039,181 | A | * | 3/2000 | Whiteside | B65D 71/125 206/427 |
| 11,801,983 | B2 | * | 10/2023 | Tallman | B65D 1/243 |
| 2008/0237326 | A1 | | 10/2008 | Bates | |
| 2016/0221765 | A1 | * | 8/2016 | Joehren | B65G 47/846 |

FOREIGN PATENT DOCUMENTS

| | | | |
|---|---|---|---|
| CN | 101284586 | A | 10/2008 |
| DE | 4429253 | | 2/1996 |
| DE | 102011107264 | | 1/2013 |
| DE | 102012011582 | A1 | 12/2013 |
| DE | 102014104644 | | 10/2015 |
| EP | 0199336 | | 10/1986 |
| WO | 2013004337 | | 1/2013 |

* cited by examiner

METHOD AND ARRANGEMENT FOR PACKAGING GROUPS OF CONTAINERS, SUCH AS BOTTLES, CANS, AND SIMILAR CONTAINERS, FOR CONTAINING BEVERAGES OR OTHER PRODUCTS

CROSS-REFERENCE TO RELATED APPLICATIONS

The present application is a Continuation-in-Part of International Patent Application No. PCT/EP2020/068205, filed Jun. 29, 2020, which claims the benefit of Federal Republic of Germany Patent Application No. DE102019119399.0, filed Jul. 17, 2019, each of which is incorporated by reference herein in its entirety.

BACKGROUND INFORMATION

1. Technical Field

The present application relates to a method and arrangement for packaging groups of containers, such as bottles, cans, and similar containers, for containing beverages or other products.

Container filling machines, such as beverage bottle filling machines, or simply filling machines, are used in the container or beverage bottle filling or bottling industry to fill containers, such as beverage bottles, with a liquid beverage. Such machines can be of a rotary or linear design. Rotary beverage bottle filling machines include a rotary carousel or rotor or similar structure that has a plurality of individual beverage bottle filling devices or beverage bottle filling stations mounted or positioned on the perimeter or periphery thereof. In operation, an individual beverage bottle is received or picked up from a bottle or container handling device or machine, such as another bottle treatment machine or a container transport or conveyor, which can be either of a rotary or linear design, and held at a corresponding individual filling device or station. While the rotary carousel rotates, each individual filling device or filling station dispenses a beverage, such as soft drinks and sodas, wine, beer, fruit juices, water, or other beverages, or another liquid product. Each individual filling device is usually designed to fill one beverage bottle or similar container at a time. Upon completion of filling, the beverage bottle or container is released or transferred to yet another bottle or container handling device or machine, such as another bottle treatment machine or transport device. The filling devices are therefore designed to fully dispense a predetermined or desired amount or volume of product into the beverage bottles or containers before the beverage bottles or containers reach the exit or transfer position out from the filling machine. The beverage bottle filling machine can also be of a linear design, wherein beverage bottles are moved to one or more filling positions along a straight or linear path.

Such filling machines are usually part of a filling or bottling plant, wherein the filling machine operates in conjunction with a number of other beverage bottle or container handling machines, such as a closing machine for placing caps or closures on filled containers, a container manufacturing machine for making or forming containers to be filled, and a container packaging machine for packaging individual containers for shipment and sale to consumers. Such plants are designed to operate as quickly and continuously as possible, and any interruptions in operation result in a loss of productivity and an increase in operating costs, especially since such plants can process large numbers of containers, such as, for example, anywhere from ten to seventy thousand containers per hour or possibly more.

Once the containers are filled and closed, the containers are usually packaged together into groups. Some packages are boxes or wraps or trays or a combination of packaging materials which contain multiple containers therein. Other packages, also known as multipacks, can be formed by connecting or joining together multiple containers using a connecting structure or joining structure, or multiple connecting structures or joining structures. For example, beverage containers, such as bottles, cans, and similar containers, are often connected together by a web of material that attaches to the beverage containers and holds them together, such as in a package or multipack of four or more containers. In some other multipacks, a connecting material is applied to the outer surface of individual containers to directly connect individual containers together in an alignment or format, such as two rows of two or three or more containers.

2. Background Art

This section is for informational purposes only and does not necessarily admit that any publications discussed or referred to herein, if any, are prior art.

In some container packaging machines and methods, carrying elements are used for multipacks in which the containers are directly connected to one another in part sections at connecting locations on the outer surface of the containers. For example, a carrying element is used that extends in the form of a disk between the containers, wherein the carrying element exhibits cut-out apertures into which the connecting locations are arranged. The locating of this carrying element requires an elaborate intervention in the production process of the multipack. In some other container packaging machines and methods, carrying elements may be connected directly to the containers. Here too, an adjustment of the method for producing the multipacks is required. In other words, in some manufacturing or packaging methods used to connect carrying elements to multipacks, the packaging method in which the containers are assembled together into a group must be altered or changed in order to utilize or incorporate the method and devices for connecting the carrying handles or similar carrying structure currently used in the packaging field. These carrying handles permit a person, such as a worker or a consumer, to manually transport the multipacks or carry them by hand.

SUMMARY

One of the possible objects of at least one possible exemplary embodiment of the present application is to provide a carrying or handle element which can be used without intervention in the production of the multipack. A further possible objects of at least one possible exemplary embodiment of the present application is to disclose a multipack with such a carrying element, the use of such a carrying element, and a method for producing a multipack. These objects could possibly be achieved by at least one possible exemplary embodiment disclosed herein.

The present application relates to a carrying element for a multipack of containers, which are connected or joined to one another in part sections at connecting locations, wherein the carrying element comprises a base, on which the multipack rests, and a carrier, wherein the carrier is connected to the base and extends from the base above the containers of the multipack.

Multipacks which are composed of containers which are connected to one another in part sections at connecting locations often prove to be unstable when being carried. The connecting locations at which the containers are, for example, adhesively bonded to one another, are in most cases small in relation to the circumference and height of the containers. Even if a carrying handle is attached, not all the containers of a multipack are stabilized when being carried. The multipack therefore gives an unstable impression when being carried.

A carrying element which is provided with a base and a carrier which extends as far as above the containers can stabilize such multipacks of which the containers are connected to one another by connecting locations. In accordance with at least one possible exemplary embodiment, multipacks of which the containers are connected by adhesive can be connected by the carrying element. A particular advantage of the carrying element according to at least one possible exemplary embodiment is that it can be used both during manufacture after the production of the multipack as well as later, when it is intended that one single multipack is to be carried.

The base of the carrying element extends at least in part sections beneath an under side of the containers. It is possible in this situation, but not necessary, for the base to cover the entire surface of all the containers. The containers do not necessarily have to stand full-surface on the base. The base can exhibit cut-ins from one edge or cut-outs in the surface of the base. In this way, with minimum use of material, a carrying element can be produced which stabilizes during carrying a multipack formed of containers connected to one another in part sections.

The carrier extends from the base as far as above the containers of the multipack. The carrier can, for example, be disk-shaped or T-shaped. As an alternative, the carrier can be structured from at least two sections, which extend as far as above the containers. The carrier and its sections can extend between the connecting locations. In a first embodiment of a multipack, the connecting locations can be applied at all locations where two containers are positioned adjacent to one another. As an alternative, for example with multipacks in two rows, the connecting locations can also be arranged in ring fashion, i.e. without connecting locations between the middle containers of a container row and the middle containers of the adjacent row. This last embodiment favors the introduction of a carrier in the multipack.

According to a first alternative, the carrying element can be configured in such a way that the carrier and the base are formed as one piece with one another. In this embodiment, the carrying element can be configured, for example, as a blank, made of card, cardboard, or plastic, wherein, before the introduction of the carrying element, the carrier is folded up out of the base. According to a second alternative, carriers and bases are attached to one another, in particular by positive or non-positive fit or bonded connection. Carrier and base are therefore produced separately from one another and then connected to one another, in positive fit, for example by tabs which engage in slots, in non-positive fit, for example by stapling or stitching, or by bonding, for example by adhesive connection. The two-part configuration has the advantage that, during production, the assembling and fitting of the carrying element can be carried out easily after the completion of the multipack. The separate production of carrier and base is also often more economical of material than the use of blanks, not only because the blanks of the individual carriers and multipacks can be produced in a more space-saving fashion than the carrying element as a whole. In accordance with at least one possible exemplary embodiment, the material for carriers and bases can be specially adjusted or selected to fulfill the particular requirements. The blank for the base, for example, can be produced from a material with greater carrying capability than the carrier, the material of which is selected rather from the consideration of greater tensile strength in comparison with the base.

A blank of the carrier according to the second alternative can be bar-shaped. A carrier according to the second alternative, however, can also be U-shaped or bow-shaped. In cases in which the carrier and base are attached to the multipack during production, bow-shaped carriers can be used, which are then inserted from the upper side of the containers through the multipack. In this way, the carrying element then directly comprises a carrier with a handle. As an alternative, before or after the assembly a handle can be attached to a free end of the carrier above the containers.

With the carrying element according to at least one possible exemplary embodiment, according to the second alternative the carrier can be connected to the base in the form of points or lines, for example by use of a linear slot in the base, through which a tab of the carrier passes, or by a sequence of adhesive points, which are arranged between the carrier and base.

The carrying element can be produced from any flat material which is capable of bearing the load imposed by the multipack. Suitable materials are, in particular, plastic, card, or cardboard. In accordance with at least one possible exemplary embodiment, the carrying element is made of corrugated cardboard. Corrugated cardboard has the advantage that it is economical, can be easily processed, and can be recycled in an environmentally-friendly manner.

With one embodiment variant, the carrier is formed as one piece or one part. As an alternative, however, the carrier can also be formed as multi-part.

According to at least one possible exemplary embodiment, the carrier of the carrying element comprises a handle. The handle can be configured as an opening at the upper end of the carrier, which projects over the containers. As an alternative, the handle can be configured as a groove or notch beneath the upper end of the carrier.

Finally, the carrier can comprise a fold point, such as a fold line or prepared fold. This embodiment is suitable for carrying elements which are fitted during production. The carrier can then be folded immediately above an upper side of the containers, such that it does not project. Only when the carrier is needed in order to carry the individual multipack is it folded up.

At least one possible exemplary embodiment further relates to a multipack, comprising containers which are connected to one another in part sections at connecting locations, such as by being adhesively bonded, and a carrying element, which comprises a base and a carrier, wherein the containers rest on the base and the carrier extends from the base as far as above the containers. As described heretofore, the combination according to at least one possible exemplary embodiment of multipack and carrying element can either be assembled during production or at the moment at which it is intended that the multipack is to be carried.

According to at least one possible exemplary embodiment, the carrier extends between containers of a multipack located adjacent to one another next to or between connecting locations. The carrier is inserted through between the containers, but in a region without connecting locations.

At least one possible exemplary embodiment provides for the carrier to extend through intermediate spaces between the containers which form the multipack. This embodiment is typical, for example, for multipack of cylindrical cans or bottles, which may be in contact with one another at connecting locations, but between which intermediate spaces are formed, which the carrier can pass through.

In accordance with at least one possible exemplary embodiment, the containers of the multipack are arranged in two rows. In accordance with at least one possible exemplary embodiment, at least one container of one of the two rows is connected to at least one container of the other row, such as by adhesive bonding.

Finally, at least one possible exemplary embodiment relates to the use of the carrying element described heretofore for connection to the multipack during production, or for subsequent connection to the multipack.

At least one possible exemplary embodiment also further relates to a method for producing a multipack with a carrying element with the steps:

moving a base of the carrying element to an under side of the multipack, moving a carrier from an upper side of the multipack as far as the base, and connecting the carrier and the base.

At least one possible advantage of the method lies in the fact the carrying element is only fitted after the multipack has been completely produced. A device for fitting the carrying element can therefore be arranged downstream of a device for the producing of multipacks. Intervention into the device for producing multipacks is not necessary with the use of the carrying element according to at least one possible exemplary embodiment. In other words, the method and the device, in accordance with at least one possible exemplary embodiment, allows for the formation and connection of the carrying element to a multipack of containers after the multipack has been formed in a current packaging device or system, and thus without the need to modify a current packaging device or system to incorporate a forming arrangement to form the carrying element.

DETAILED DESCRIPTION

Figure 1:
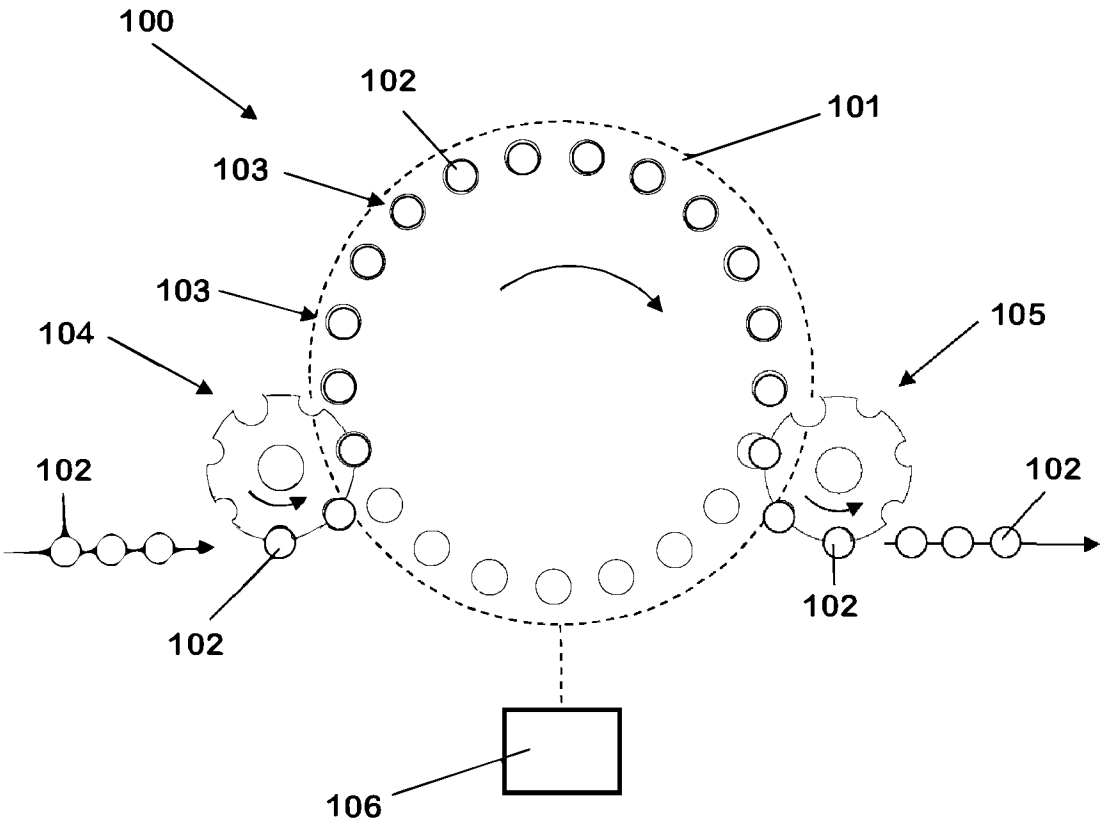
FIG. 1 shows a schematic top view of a container handling or beverage bottling machine in accordance with at least one possible exemplary embodiment.

FIG. 1 shows a schematic top view of a container handling or beverage bottling machine 100 for handling containers 102, such as bottles, cans, kegs, or similar containers, in accordance with at least one possible exemplary embodiment. The container handling machine 100 comprises a rotor or carousel 101 designed to rotate about a vertical axis of rotation. A plurality of container handling arrangements 103 are disposed about the periphery of the rotor 101. The container handling arrangements 103 can be designed to perform different functions depending on the container handling machine 100, such as container filling, closing, labeling, and other such container handling functions. A first rotary container transport device 104, such as a star wheel or similar device, moves containers 102 into the container handling arrangements 103. A second rotary container output device 105, such as a star wheel or similar device, moves containers 102 out of the container handling arrangements 103. A control arrangement 106, such as a computer control arrangement, is operatively connected to the container handling machine 100 to control and/or monitor the operation of the container handling machine 100 and the components thereof. Once the beverage containers are filled, closed, and optionally labeled, the beverage containers can be moved to one or more beverage container packaging machines that organize the individual beverage containers into packs or multipacks.

FIGS. 1*a*, 1*b*, 1*c*, 1*d*, and 1*e* show exemplary embodiments of carrying elements 1, which are intended to be attached to a multipack formed from containers which are connected to one another at part sections. All the carrying elements have the feature in common that they comprise a base 2 and at least one carrier 3, and often two carriers 3, 4. The dimensions of the carriers 3, 4 are adjusted according to the spacing interval between the connecting locations of the respective multipack. The width of the carrier 3 or the carriers 3, 4 can be dimensioned as a maximum to be as wide as the spacing interval between two connecting positions. The base 2 is dimensioned in such a way that the containers of a multipack can be carried securely. For this purpose it is sufficient in most cases for the base 2 to cover sections of an under side of the containers, since the containers are already stabilized in the multipack by the connecting locations. The carrying element 1 according to at least one possible exemplary embodiment can therefore be configured as very economical in material.

The carrying elements 1 can be produced from any flat material which exhibits sufficient strength to carry the multipack. Suitable materials for producing the carrier are card, cardboard, corrugated cardboard, or plastic, which all exhibit a good weight to strength ratio. FIGS. 1*a*, 1*b*, 1*c*, 1*d*, and 1*e* show different embodiments of the carrying element 1. It is expressly noted that the individual features of the embodiments can be freely combined in at least one or more possible exemplary embodiments.

Figure 1A:
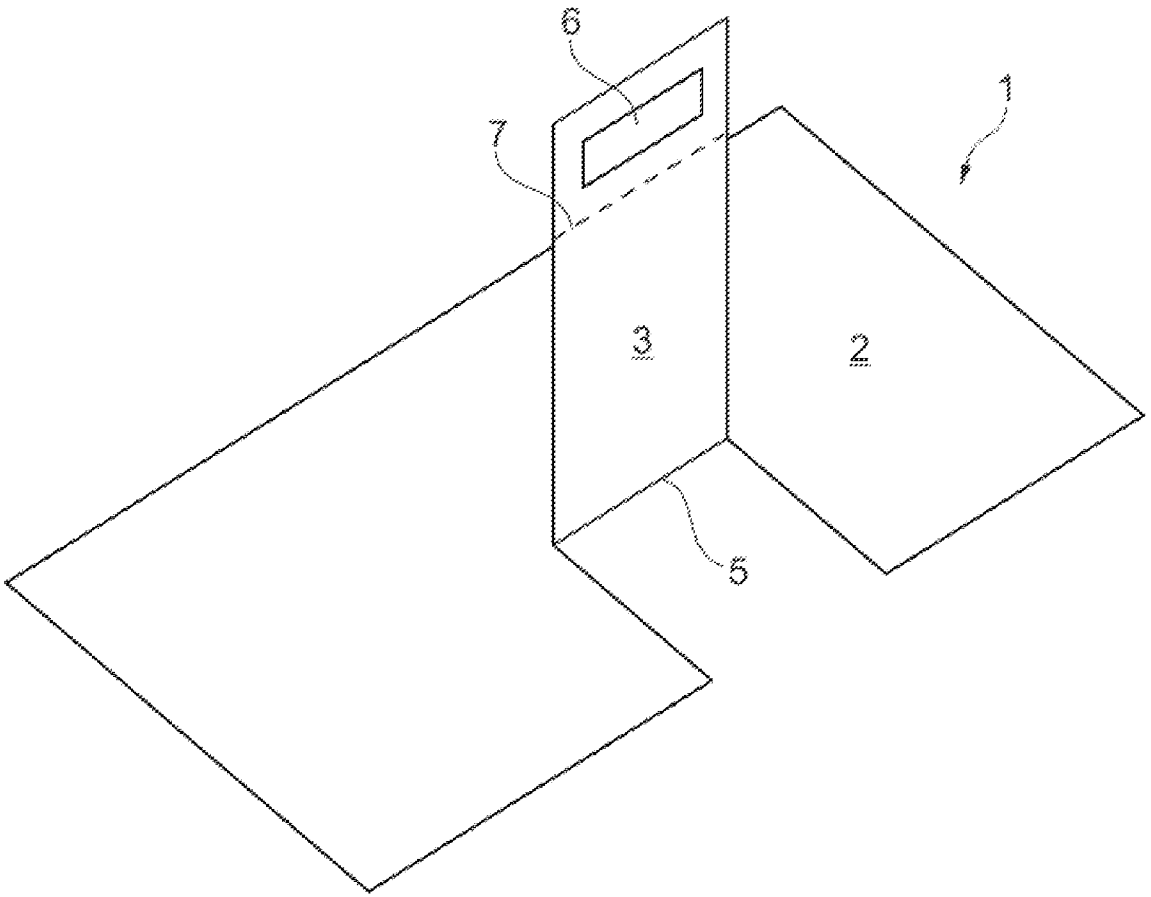
FIGS. 1*a*, 1*b*, 1*c*, 1*d*, and 1*e* show exemplary embodiments of carrying elements in a schematic representation.

FIG. 1*a* shows a material blank, which forms the base 2 of a carrying element 1. A tab is cut out of the base 2, which can be folded up to form a carrier 3. The carrier 3 is connected to the base by way of a first fold line 5. At the free end of the carrier 3 a cut-out opening 6 is provided, which serves as a handle. Arranged beneath the cut-out opening is a second fold line 7, by means of which, after the fitting of the carrying element 1 to the container, the projecting free end of the carrier 3 can be folded around above the containers, such that the carrier 3 does not cause any interference when the multipack is being handled, such as during shipping of the multipacks. If it is intended that the multipack should be carried later by the carrier 3, the carrier 3 can be straightened again, such that the multipack can be carried by the handle.

Figure 1B:
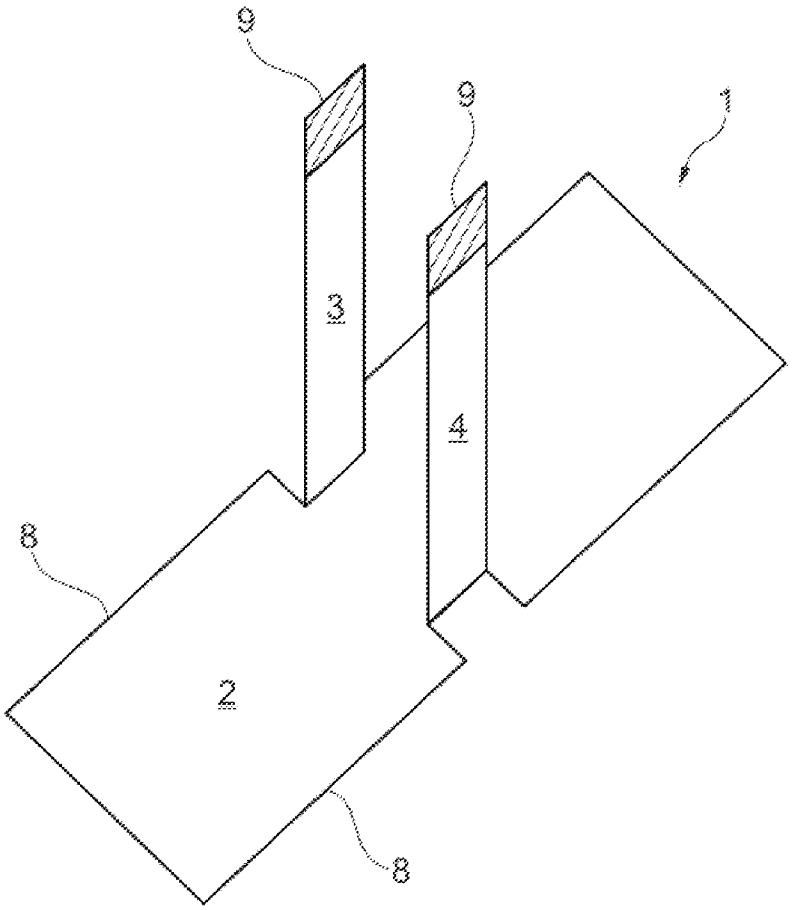

FIG. 1*b* shows a material blank, which forms the base 2 of the carrying element 1. Cut out of the base 2, on the opposing sides 8, are two mutually opposing tabs, as carriers 3, 4, which in each case can be folded up in relation to the base 2. At least one upper free end 9 of the carriers 3, 4, which faces away from the base 2, is provided with bonding adhesive. The carriers 3, 4, are dimensioned to be sufficiently long that they project over the containers of the multipack, and, after folding up, can be adhesively bonded to the free ends 9. As an alternative, the upper free ends 9 of the tabs are not provided with adhesive, and, after attachment to the multipack, can be connected to one another, for example by connecting structures such as attachment clamps. According to an alternative embodiment, the carrying element 1 can also comprise two or more pairs of carriers 3, 4, for example in order to be able to carry larger or heavier multipacks.

Figure 1C:
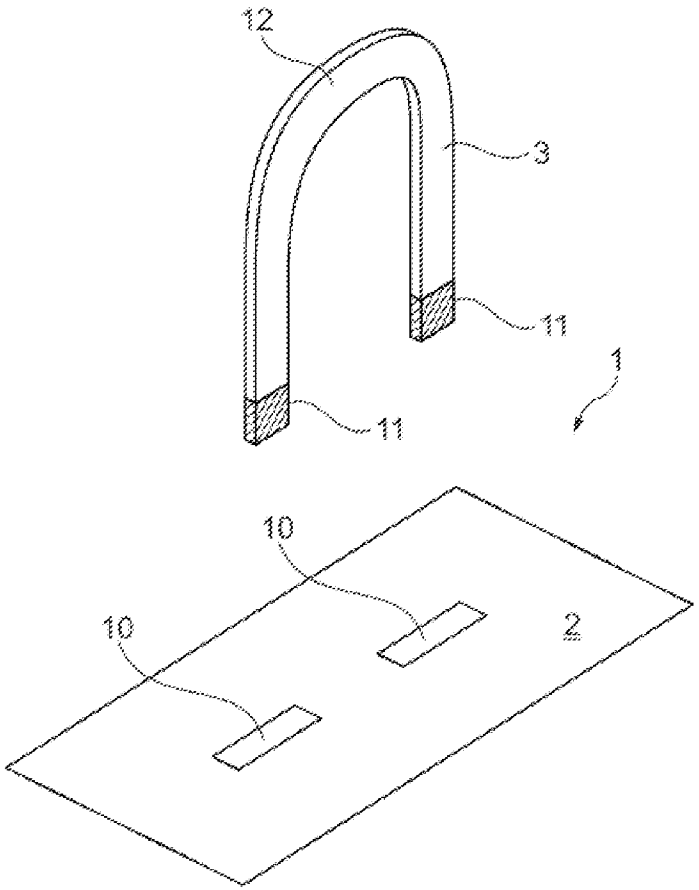

FIG. 1*c* shows a material blank, which forms the base 2 of the carrying element 1. Formed in the base 2 are two openings 10, which are mostly extended longitudinally. The carrier 3 is formed as a separate blank, and configured as essentially or substantially U-shaped. The lower free ends 11 of the carrier 3 are dimensioned and spaced at a distance from one another in such a way that, at the assembly of the carrying element 1 to the multipack, they are inserted through the openings 10 and can be connected to the base 2. The lower free ends 11 of the carrier 3 can be folded over and adhesively bonded to the base 2 or connected mechanically, for example by tacking or locking in place. The multipack provided with the carrying element 1 can be carried at the middle region 12 of the carrier 3. With the embodiments of the carrying element 1, the base 2 and the carrier 3 can be produced from the same material or from different materials. The base 2 can be selected according to the criteria of pressure resistance or flexural strength, while the carrier or carriers 3, 4 can be selected according to the criterion of tensile strength. In this way the carrying element 1 can be produced with minimum material expenditure.

Figure 1D:
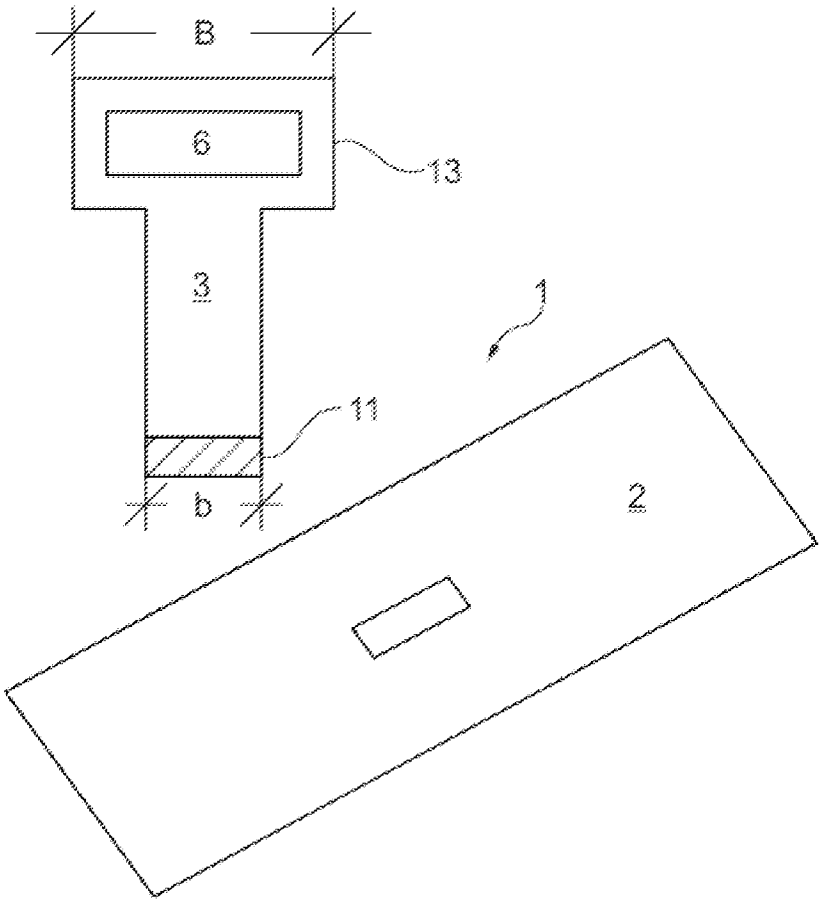

FIG. 1*d* shows a material blank, which forms the base 2 of the carrying element 1. The base 2 is provided with an opening 10. A second blank forms the carrier 3, which at its lower free end 11, facing the base 2, is configured so as to be connected to the base 2 by an adhesive or connecting structures or devices such as, for example, clamps or a locking arrangement. At the opposite end 13 of the carrier 3, the carrier 3 exhibits a greater width B than at the free end 11, which exhibits a smaller width b. The carrier 3 can be carried at the projection which is formed by the greater width B in relation to the width b.

According to at least one possible exemplary embodiment, an opening 6 can be provided in the upper region 13, which serves as a handle to carry the multipack.

Figure 1E:
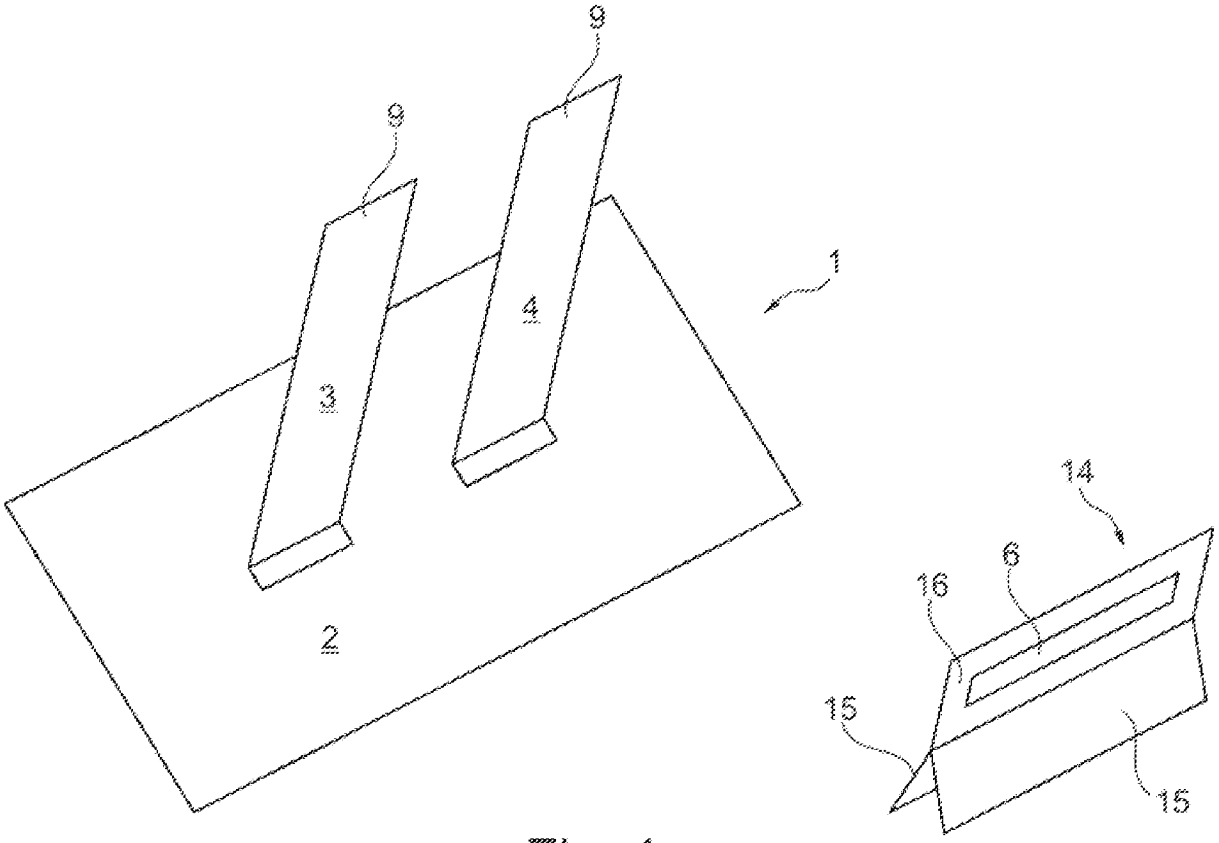

FIG. 1*e* shows a configuration of the carrying element 1, in which the base 2 is provided with two carriers 3, 4 arranged in a row. The carriers 3, 4 can be cut out of the base as tabs, or connected as separate blanks to the base by tacking, adhesive bonding, or a locking arrangement. During the assembly, the carriers 3, 4 stand perpendicular to the base 2. During the assembly of the carrying element 1, a handle element 14 is attached to the free ends 9 of the carriers 3, 4. The handle element has at least one connecting section 15. In the configuration shown in FIG. 1*e*, there are two connecting sections 15. The connecting section or sections 15 are in contact at both free ends 9 of the carriers 3, 4, and are connected to these, for example by adhesive bonding, tacking, or a locking arrangement. In a simple configuration, the multipack can then be carried at the connecting section 15. According to the configuration shown in FIG. 1*e*, a loop 16 is formed above the connecting sections 15, into which an opening 6 is introduced which is used as a handle. Advantageous with this somewhat more elaborate arrangement is that the handle element 14 offers a relatively large surface for advertising printing or product information.

All the configurations of the carrying element, according to at least one possible exemplary embodiment, have the feature in common that they do not cover the outer surface of the containers of the multipack, and that, with minimum use of material, they allow for comfortable carrying of the multipack. At least one possible exemplary embodiment of the carrying element is such that it can be both introduced into the finished multipack during production as well as being subsequently inserted by the customer, as required, into the multipack in order to carry it better.

Hereinafter, using the example from FIG. 2, the mounting of the carrying element 1 on a finished multipack 17 is explained. In this embodiment, the multipack 17 consists of six cylindrical containers, which are arranged in three rows of two containers each. The connecting locations of adhesive are arranged in ring form, such that there is no connecting location between the two containers of the middle row. This embodiment of a multipack leaves a particularly large amount of space between the two containers of a row, in order to arrange one or two carriers 3, 4 of a carrying element 1 between the containers of the finished multipack 17. Base 2 and carrier 3 of the carrying element 1 are in this case configured, for example, as explained in detail in connection with FIG. 1*c*.

Next, a base 2 is introduced on the under side to the multipack 17, being conveyed in the conveying direction F on a conveying device 18, and positioned beneath the under side. At the same time or after this, the carrier 3 is introduced from the upper side, and guided between the containers of the multipack 17 as far as beneath the base 2. The base 2 and carrier 3 are in each case taken from magazines by extraction devices, not represented in any greater detail, and, supported by positioning devices if appropriate, are arranged by a moving arrangement, not represented in greater detail here, for moving beneath the containers of the multipack 17, as well as being moved from the upper side of the multipack 17.

The partially-curved carrier 3 is moved in such a way that the free ends 11 of the carrier are guided between the containers of the multipack 17, through the openings 10 in the base 2, as far as beneath the base 2. The middle region 12 of the carrier 3 remains above the upper end of the containers 17, and serves as a handle.

Following this, the free ends 11 of the carrier are provided with adhesive, by an application arrangement 19 configured to apply adhesive, such as, for example, an adhesive application nozzle or roller. Arranged following this in the conveying direction F, at the conveying device 18, is a connecting arrangement 20 for connecting the free ends 11 of the carrier 3 to the base 2. In the simplest case, the connecting arrangement 20 is configured as a forming edge or forming plate, which bends the free ends 11 of the carrier 3 provided with adhesive over until they are in contact on the under side of the base 2. A fixing arrangement 21 for fixing the connection between the carrier 3 and base 2 then presses the free ends to the base 2. The fixing arrangement 21 can be configured, for example, as a forming plate, which exerts pressure onto the free ends 11 and press them against the base 2. The base 2 is stabilized by the weight of the multipack 17, such that pressure from the under side onto the free ends 11 in contact on the base 2 is sufficient to establish a firm connection with the base. The pressure is maintained until the connection is fixed or hardened. The fixing arrangement 21 can either be in a fixed location or can be transported with the multipack 17 along the conveying device 18. As an alternative, a tacking or locking connection can be established. These connections can also be established from the under side alone.

Optionally, during the connection of the carrier 3 and the base 2, or following this, the middle section 12 of the carrier 3 can be folded onto the upper side of the containers of the multipack 17. In order to simplify this folding, the carrier can comprise a folding line in the region of the folding.

From the foregoing it becomes clear that the carrying element 1 can be attached subsequently to an already finished multipack 17 in an uncomplicated manner. In accordance with at least one possible exemplary embodiment, provision is made for the carrier or carriers 3, 4 to engage closely at the point of balance of the multipack 17, such that large-volume and/or heavy multipacks can be carried with a carrying element 1 which is economical with material.

Figure 2:
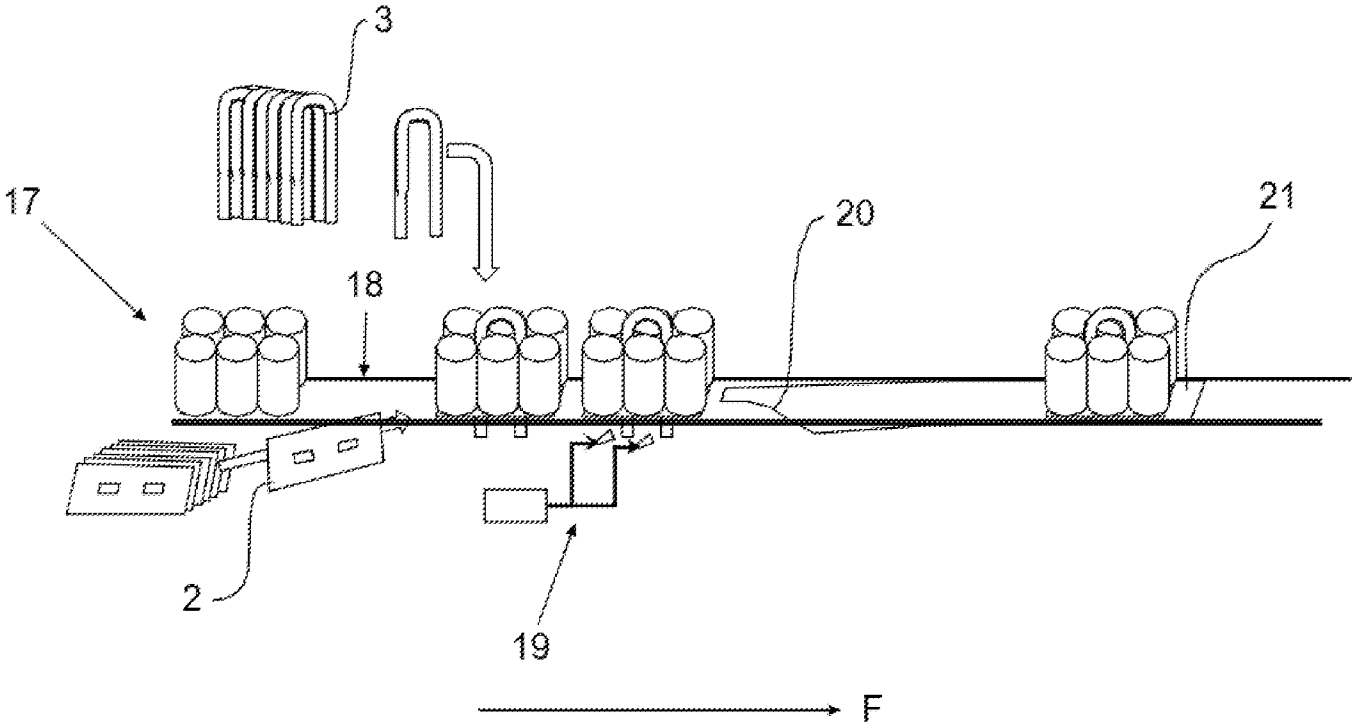
FIG. 2 shows an attachment during production of a carrying element to a finished multipack according to a first embodiment in a schematic representation.
Figure 3:
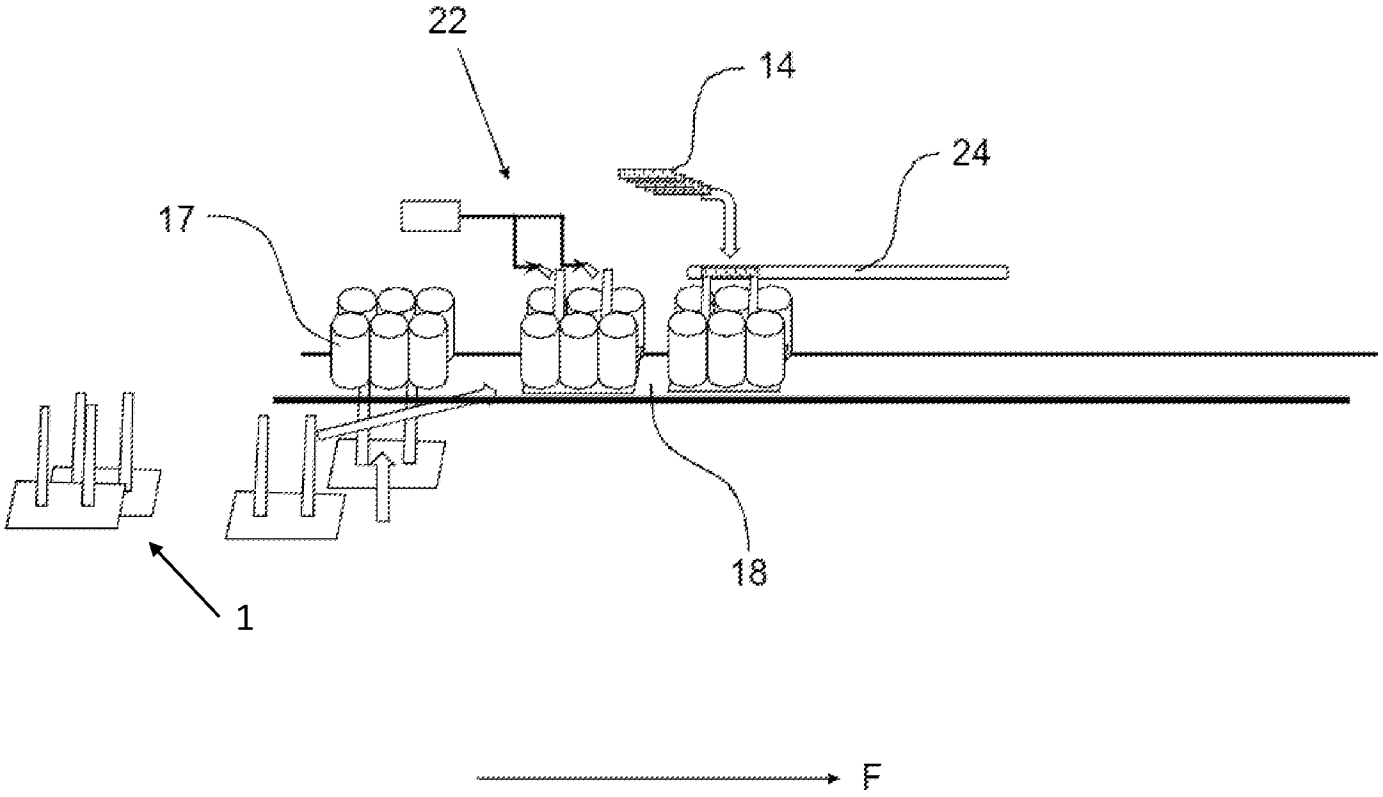
FIG. 3 shows an attachment during production of a carrying element to a finished multipack according to a second embodiment in a schematic representation.
Figure 3B:
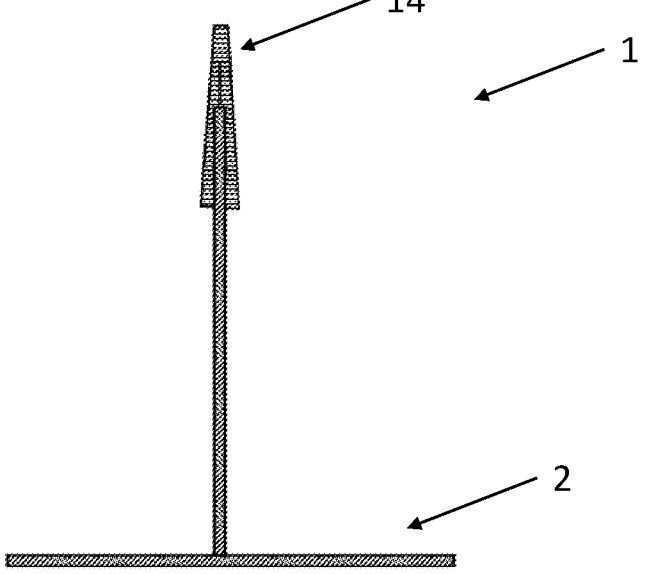
FIG. 3*b* shows a carrying element according to FIG. 1*e* in cross-section after assembly.
Figure 3A:
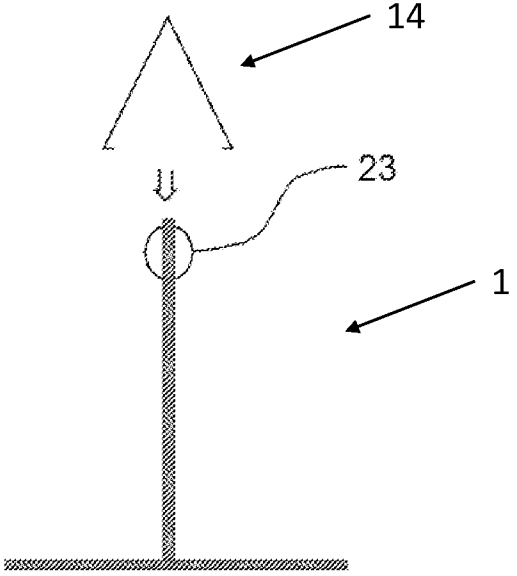
FIG. 3*a* shows a carrying element according to FIG. 1*e* in cross-section before assembly.

FIG. 3 shows a similar method as in FIG. 2, carried out with a comparable device 18, although here a base 2 is used which is already provided with two carriers 3, 4, as is represented in FIG. 1*e*. Accordingly, it is not necessary, after the positioning of the base 2 from the under side of the multipack 17, for the carriers 3, 4 and the base 2 to be connected to one another. For this purpose, a device 22 for applying adhesive is arranged above the multipack, which applies adhesive onto the free ends 9 of the carriers 3, 4. FIG. 3*a* shows the carrying element 1, by itself without a multipack being shown, in cross-section after the application of the adhesive 23. Next, a connecting element 14, with two parallel connecting sections 15, is arranged over the free ends 9 of the carriers 3, 4, in such a way that in each case a connecting section 15 is in contact on each side of a free end 9 of the carriers 3, 4. FIG. 3*b* shows the carrying element 1, by itself without a multipack being shown, in cross-section after the joining of the carrying element 1 and connecting element 14. Following this, a joining arrangement 24 for joining the connecting element 14 to the carriers 3, 4, is arranged above the multipack 17. This can involve simple wearing or pressing plates, but also a sequence of rollers, which exert pressure onto the connecting element 14 for as long as necessary or desired until the connecting element 14 and carriers 3, 4, are joined sufficiently securely.

Figures 4A, 4B, 4C:
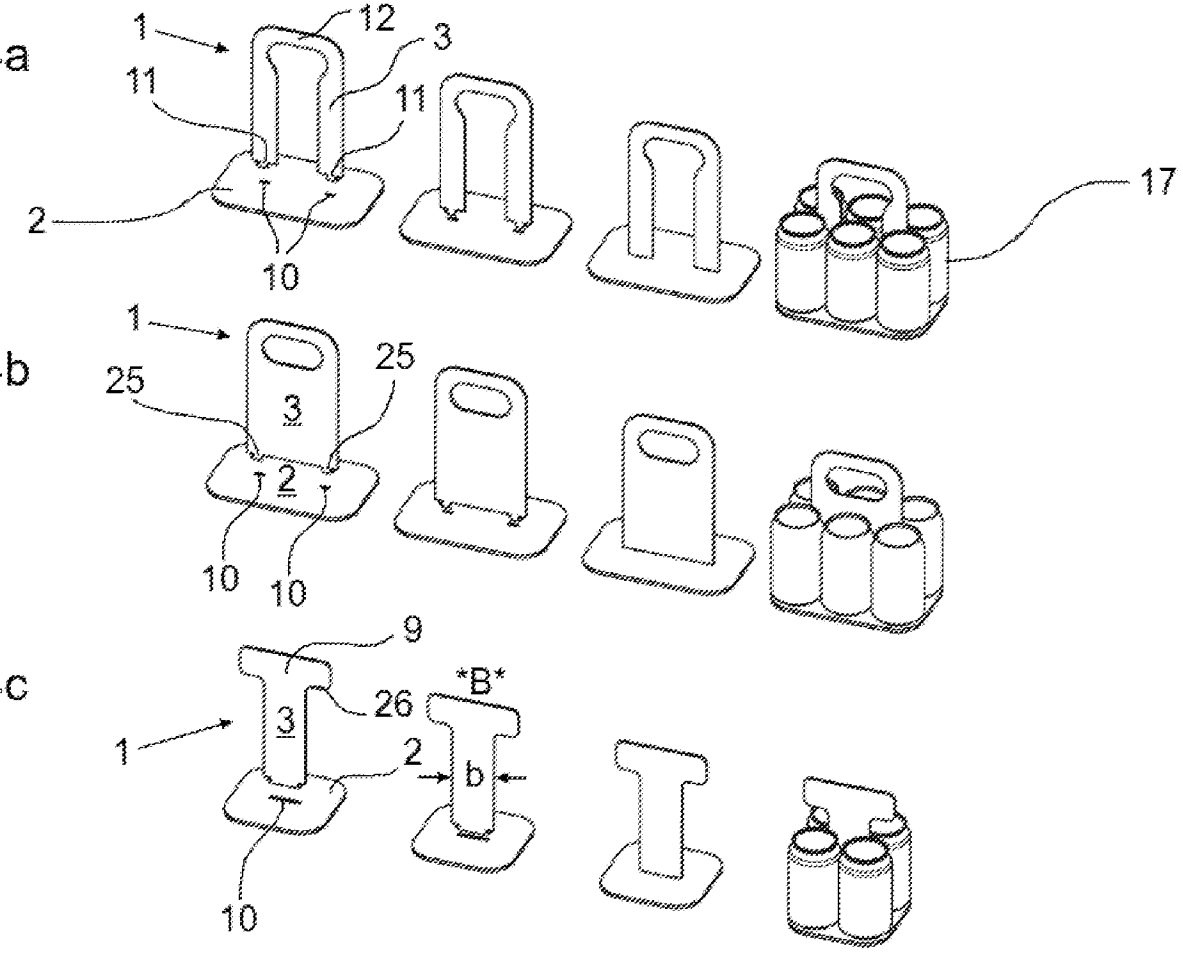
FIGS. 4*a*, 4*b*, and 4*c* show exemplary embodiments of carrying elements for subsequent assembly in a perspective view.

FIGS. 4*a*, 4*b*, and 4*c* show different carrying elements 1 for subsequent attachment to the multipack 17. The respective carrying elements 1 can be folded after production and until use, and can therefore be stored and transported in a space-saving manner.

FIG. 4*a* shows a carrying element in a configuration according to FIG. 1*c*, which is mounted by the attachment of the carrier 3 onto the base 2. Following this, the free ends 11 of the carrier 3 are inserted through the openings 10 in the base 2 and then adhesively bonded to the base 2. Attached onto this carrying element 1 is a multipack 17, wherein the containers are connected in each case to the adjacent container of a neighboring row, but the two containers of the middle row are not connected to one another.

FIG. 4*b* shows a carrying element 1, where the carrier 3 comprises two tabs 25 at its end facing towards the base, which are inserted through the openings 10 in the base 2 of the carrying element 1 and are adhesively bonded to the base. Arranged in the free end 9 of the carrier 3 is an opening 6. This produces a carrying handle. The carrier 3 is wide, and therefore almost fills the gap between two connecting locations of the multipack 17. The base 2 corresponds in its dimensions to the dimensions of the multipack 17. This configuration is particularly well-suited for heavy multipacks.

When the transport element 1 is displaced from the under side to the upper side of the multipack, the carrier or carriers 3, 4, generally occupy the space between the containers, which can be cylindrical containers, such as cans or bottles. The connecting locations between the containers are so elastic, however, that a carrier can also be pushed through between two immediately adjacent containers, provided that no connecting location is arranged at this point.

All the sections of the carriers 3, 4, which project over the upper side of the containers can be folded onto the upper side of the containers, whether with or without a folding line.

FIG. 4*c* shows a carrying element 1, wherein a T-shaped carrier 3 comprises at its lower end a tab, which is inserted though an opening 10 in the base 2, and then adhesively bonded to the base 2. The upper free end 9 of the carrier 3 exhibits a width B, which is greater than the width b at the lower end of the carrier 3. Due to the transition from the width B at the free end 9 to the width b, an undercut 26 is formed. As a result, the free end 9 becomes a handle, by which the multipack can be carried. The carrying element 1 is used to carry a multipack of four containers. The carrier passes through the space between the containers.

Figure 5:
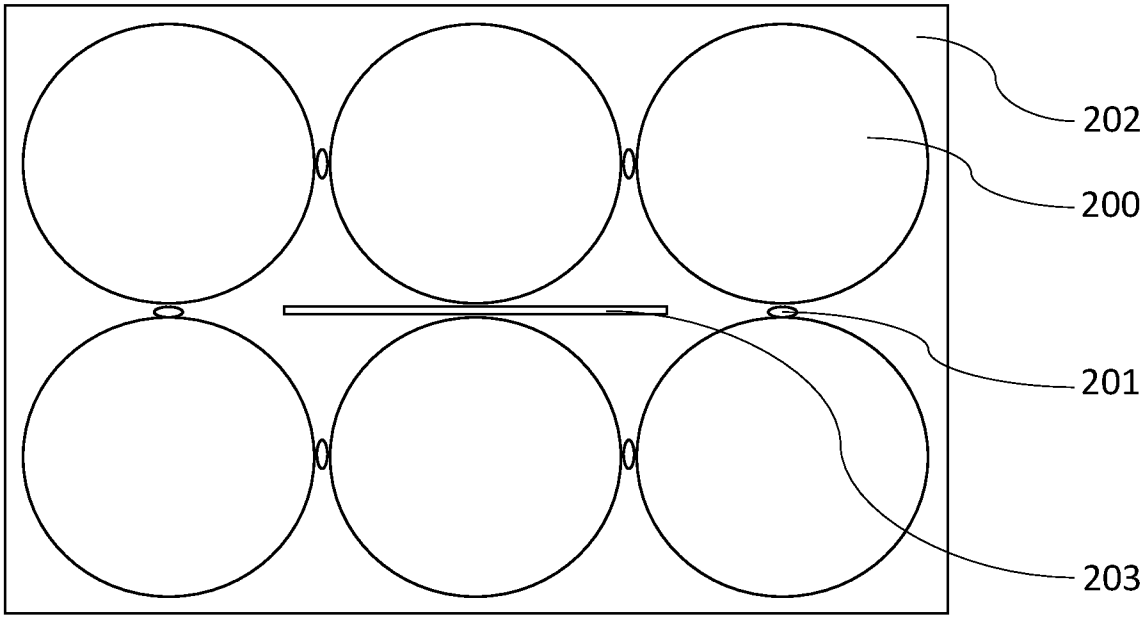
FIG. 5 shows a schematic top view of a multipack and carrying element according to at least one possible exemplary embodiment.
Figure 6:
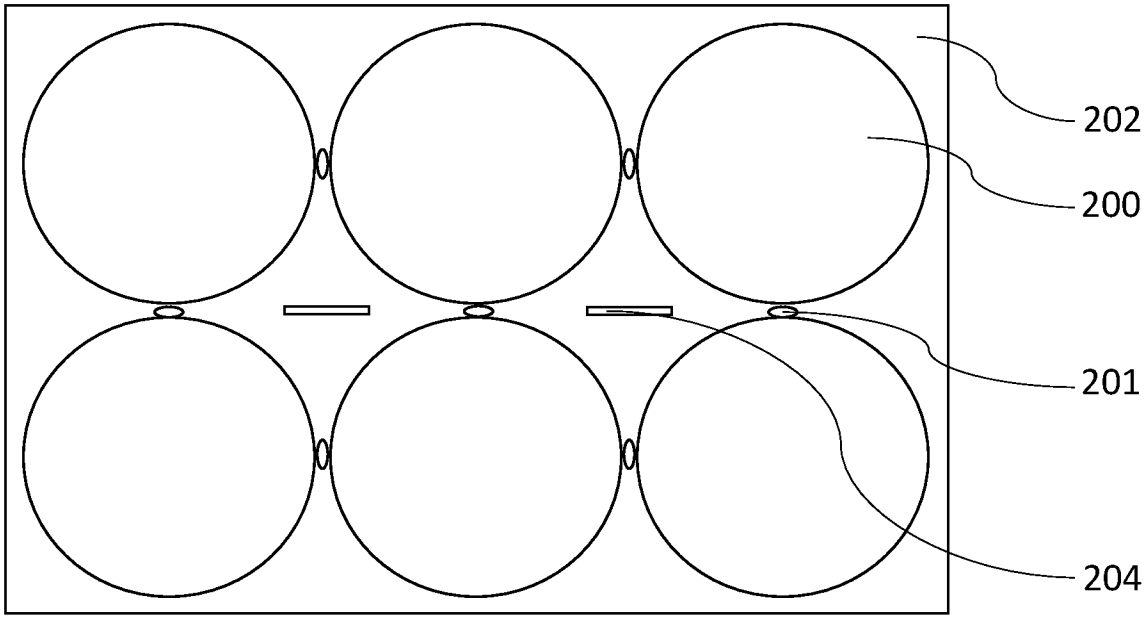
FIG. 6 shows a schematic top view of a multipack and carrying element according to at least one possible exemplary embodiment.

FIG. 5 shows a schematic top view of a multipack and carrying element according to at least one possible exemplary embodiment. FIG. 6 shows a schematic top view of a multipack and carrying element according to at least one possible exemplary embodiment. These views show an example of how the containers could possibly be connected together and how the carrier structure or structures could be positioned within the multipack of containers. These figures should be understood to show exemplary embodiments meant for explanation and should not be understood as limiting any of the embodiments disclosed herein, though features or concepts shown thereby could be applicable to one or more exemplary embodiments disclosed herein.

In FIG. 5, six individual containers 200 are joined or connected together by a connecting structure 201, which can be in the form of an adhesive material, connected to the outer surfaces of the containers 200 themselves, to thereby form a multipack. The connecting structures 201 join or connect the containers 200 together so that the containers 200 generally maintain their format or formation in rows of three. In the exemplary embodiment shown in FIG. 5, a base 202 of a carrying element is positioned under the containers 200. A carrier 203 is connected to the base 202 and projects away from the base 202 between the containers 200. It should be noted that there is no connecting structure 201 between the middle containers 200 in each of the two rows of containers 200, such that the six connecting structures 201 are arranged in a sort of ring around a hollow or empty central region of the multipack. This absence of a connecting structure 201 allows the carrier 203 to pass or be positioned between the middle containers 200 as shown, much like the carriers shown in FIGS. 1*a* and 1*d*, for example. In contrast, FIG. 6 shows a situation in which all containers 200 have a connecting structure 201 between adjacent container surfaces. In this situation, a carrier such as the carrier 203 could not be used, so instead two or more separate carrier structures 204 could be used, much like the carrier shown in FIG. 1*c*, wherein the connecting structure 201 is located between the two carrier structures 204. The two carrier structures 204 could be part of a single structure, like the carrier 3 in FIG. 1*c*, or could be joined by a connecting piece at their free ends, like the carriers 3, 4 in FIG. 1*e*.

The following is at least a partial list of components shown in the figures and their related reference numerals: carrying element 1; base 2; carrier 3; carrier 4; first fold line 5; cut-out opening 6; second fold line 7; sides of the carrying element 8; upper free end of the carrier 9; opening in the base 10; lower free end 11; middle region of the carrier 12; upper region of the carrier 13; handle element 14; connecting section 15; loop 16; multipack 17; device for conveying the multipacks 18; means for applying adhesive 19; means for connecting 20; means for fixing 21; device for applying adhesive 22; adhesive 23; joining means 24; tabs 25; and undercut 26.

It should be noted that a positive fit or positive force or positive guidance, in the context of this application, refers to a situation in which at least two components engage in a form fit, that is, at least a portion of an outer edge or boundary or surface of a first component substantially or essentially conforms to or fits within a corresponding portion of an inner edge or boundary or surface of a second component. This form fit between the two components results in the first component being retained against movement or displacement out of engagement with the second component. A common type of positive fit is when a first component is bound on at least one side or portion by a retaining structure, such as a side wall or guide surface, of a second component, such that, when a force is applied to move the first component in the direction of and against the retaining structure of the second component, the retaining structure resists movement or displacement of the first component, that is, the retaining structure acts like a wall or similar to block the movement. Male and female components that are connected by tabs or shoulders are another example of a positive or form fit. A positive guidance can occur when the first component is movable and the second component is a guide structure, wherein as the first component is moved into contact with the second component, the first component is deflected or guided along the path of movement defined or bounded by the second component. Again, the movement or displacement of the first component in a certain direction is resisted or blocked by the guide wall or surface of the second component, such that the first component is physically deflected or guided by the second component in a different direction or path of movement.

It should also be noted that a non-positive fit or non-positive force or non-positive guidance, in the context of this application, refers to a situation in which at least two components engage in a friction fit, that is, at least a portion of an edge or boundary or surface of a first component is in frictional engagement or contact with a corresponding portion of an edge or boundary or surface of a second component. This friction fit between the two components results in the first component being retained by friction against a sliding or translating movement or displacement with respect to the second component. A common type of non-positive fit is when a surface portion of the first component is positioned in contact with a corresponding or matching surface portion of the second component, such that, when a force is applied to move the first component along or across the surface portion of the second component, the friction between the surfaces at least resists movement or displacement of the first component, and prevents movement if the friction force is greater than the movement force. It is not uncommon for two components to engage in both a positive fit due to at least a partially matching or corresponding structural design that forms a retaining surface, and a non-positive fit due to frictional forces between surfaces of the components that are in frictional contact with one another. In such a situation, the positive fit and non-positive combine to produce a greater retaining or resisting force than would be generated or provided by one or the other alone.

At least one possible exemplary embodiment of the present application relates to a carrying element 1 for a multipack 17 of containers, which are connected in part sections at connecting locations, in particular adhesively bonded, to a base 2, on which the multipack 17 rests, and a carrier 3, 4 which is connected to the base 2 and which extends from the base 2 to above the containers of the multipack 17.

At least one other possible exemplary embodiment of the present application relates to the carrying element, wherein the carrier 3, 4 is disk-shaped or comprises at least two sections, which extend from the base 2 to above the containers of the multipack 17.

At least one other possible exemplary embodiment of the present application relates to the carrying element, wherein the carrier 3, 4 is connected to the base 2 at points or in the form of lines.

At least one other possible exemplary embodiment of the present application relates to the carrying element, wherein the carrying element 1 is produced from a flat material, in particular from plastic, card, or cardboard, or corrugated cardboard.

At least one other possible exemplary embodiment of the present application relates to the carrying element, wherein the carrier 3, 4 and the base 2 are configured as being of one piece.

At least one other possible exemplary embodiment of the present application relates to the carrying element, wherein the carrier 3, 4 and the base 2 are joined to one another, in particular in positive, non-positive, or material bond.

At least one other possible exemplary embodiment of the present application relates to the carrying element, wherein the carrying element 1 comprises a handle.

At least one other possible exemplary embodiment of the present application relates to the carrying element, wherein the carrier 3, 4 exhibits a folding line 7.

At least one other possible exemplary embodiment of the present application relates to the carrying element, wherein the carrier 3, 4 is configured as being of one part.

At least one other possible exemplary embodiment of the present application relates to the carrying element, wherein the carrier 3, 4 is configured as being multi-part.

At least one other possible exemplary embodiment of the present application relates to the carrying element, wherein the base 2 and the carrier 3, 4 are produced from the same material.

At least one other possible exemplary embodiment of the present application relates to the carrying element, wherein the base 2 and the carrier 3, 4 are produced from different materials.

At least one possible exemplary embodiment of the present application relates to a multipack 17, comprising containers which are connected to one another in part sections at connecting locations by being adhesively bonded, and a carrying element 1, which comprises a base 2 and a carrier 3, 4, wherein the containers rest on the base 2 and the carrier 3, 4 extends from the base 2 to above the containers.

At least one other possible exemplary embodiment of the present application relates to the multipack 17, wherein the carrier 3, 4 extends through intermediate spaces between the containers.

At least one other possible exemplary embodiment of the present application relates to the multipack 17, wherein the carrier 3, 4 extends between containers adjacent to one another next to or between connecting locations.

At least one other possible exemplary embodiment of the present application relates to the multipack 17, wherein the containers are arranged in two rows, and at least one container of one of the two rows is connected, in particular adhesively bonded, to at least one container of the other row.

At least one possible exemplary embodiment of the present application relates to a use of the carrying element 1, for connection during production to the multipack 17 or for subsequent connection to the multipack 17.

At least one possible exemplary embodiment of the present application relates to a method for producing a multipack 17 with a carrying element 1 with the steps: moving of a base 2 of the carrying element 1 to an under side of the multipack 17, moving of a carrier 3, 4 from an upper side of the multipack 17 as far as the base 2, and connecting of carrier 3, 4 and base 2.

At least one possible exemplary embodiment of the present application relates to a container multipack carrying arrangement configured to permit carrying of multipacks of containers, such as bottles, cans, and similar containers configured to hold or contain a beverage, such as water, soft drinks, beer, wine, and juices, or a similar product, said container multipack carrying arrangement comprising: a container base support structure configured to be disposed under the containers of a container multipack, which containers are connected together by adhesive connecting structures positioned between and connected to adjacent portions of the outer surfaces of pairs of containers; said container base support structure being configured to support the containers of a container multipack thereon to permit transport or carrying of the container multipack with said container multipack carrying arrangement; and at least one carrier structure being connected to said container base support structure and being configured to extend from said container base support structure over a height greater than or equal to the height of the containers of a container multipack to be carried by said container multipack carrying arrangement, such that a projecting portion of said at least one carrier structure, upon said at least one carrier structure being positioned at a container multipack, is disposed past the tops of the containers of the container multipack.

At least one other possible exemplary embodiment of the present application relates to the container multipack carrying arrangement, wherein said at least one carrier structure comprises one of (A), (B), or (C): (A) a base end portion being connected to said container base support structure; and a body portion being configured and disposed to connect said base end portion to said projecting portion; (B) two base end portions being connected to said container base support structure; two body portions being configured and disposed to connect said base end portion to said projecting portion; and said projecting portion comprising an at least partially curved section being integrally formed with said two body portions to form a single structure; (C) two base end portions being connected to said container base support structure; two body portions being configured and disposed to connect said base end portion to said projecting portion; and said projecting portion comprising two projecting portions being disposed one on each of said two body portions and being configured to be connected together.

At least one other possible exemplary embodiment of the present application relates to the container multipack carrying arrangement, wherein said at least one carrier structure is connected to said container base support structure at points by one or more connecting structures or by a continuous, elongated connecting structure.

At least one other possible exemplary embodiment of the present application relates to the container multipack carrying arrangement, wherein at least one of said container base support structure and said at least one carrier structure comprising a substantially flat material comprising at least one of: plastic, card, cardboard, and corrugated cardboard.

At least one other possible exemplary embodiment of the present application relates to the container multipack carrying arrangement, wherein one of (D) and (E): (D) said at least one carrier structure and said container base support structure are configured as being one integral structure; and (E) said at least one carrier structure and said container base support structure are joined to one another by one of: a positive connection, a non-positive connection, or a material bond.

At least one other possible exemplary embodiment of the present application relates to the container multipack carrying arrangement, wherein said at least one carrier structure comprises a handle configured to permit manual carrying of the container multipack carrying arrangement.

At least one other possible exemplary embodiment of the present application relates to the container multipack carrying arrangement, wherein said at least one carrier structure comprises at least one weakened or pressed section configured to permit folding of at least one portion of said at least one carrier structure, either over another portion of said at least one carrier structure, over the tops of containers of a multipack, or with respect to said container base support structure.

At least one other possible exemplary embodiment of the present application relates to the container multipack carrying arrangement, wherein said container base support structure and said at least one carrier structure comprise the same material.

At least one other possible exemplary embodiment of the present application relates to the container multipack carrying arrangement, wherein said container base support structure and said at least one carrier structure comprise different materials.

At least one other possible exemplary embodiment of the present application relates to the container multipack carrying arrangement, wherein said at least one carrier structure is connected to at least one central portion of said container base support structure, which said at least one central portion is disposed such that, upon positioning of a container multipack on said container base support structure, said at least one carrier structure passes through at least one space between containers of the container multipack.

At least one other possible exemplary embodiment of the present application relates to the container multipack carrying arrangement, wherein said at least one carrier structure is configured to extend through at least one small space between the immediately adjacent outer surfaces of two containers of a container multipack not connected to one another by an adhesive connecting structure.

At least one other possible exemplary embodiment of the present application relates to the container multipack carrying arrangement, wherein said at least one carrier structure is configured to extend through an open space formed within a group of four containers and between adhesive connecting structures.

At least one possible exemplary embodiment of the present application relates to a container multipack arrangement comprising a multipack of containers, such as bottles, cans, and similar containers configured to hold or contain a beverage, such as water, soft drinks, beer, wine, and juices, or a similar product, and a container multipack carrying arrangement being configured to permit carrying of said container multipack and comprising: a container base support structure being disposed under the containers of said container multipack, which containers are connected together by adhesive connecting structures positioned between and connected to adjacent portions of the outer surfaces of pairs of containers; said container base support structure being configured and disposed to support the containers of said container multipack thereon to permit transport or carrying of the container multipack with said container multipack carrying arrangement; and at least one carrier structure being connected to said container base support structure and being configured and disposed to extend from said container base support structure over a height greater than or equal to the height of the containers of a container multipack to be carried by said container multipack carrying arrangement, such that a projecting portion of said at least one carrier structure, upon said at least one carrier structure being positioned at a container multipack, is disposed past the tops of the containers of the container multipack.

At least one other possible exemplary embodiment of the present application relates to the container multipack arrangement, wherein said at least one carrier structure extends through at least one small space between the immediately adjacent outer surfaces of two containers of said container multipack not connected to one another by an adhesive connecting structure.

At least one other possible exemplary embodiment of the present application relates to the container multipack arrangement, wherein the containers are arranged in two rows, and at least one container of one of the two rows is adhesively connected to at least one container of the other row.

At least one other possible exemplary embodiment of the present application relates to the container multipack arrangement, wherein said containers of said container multipack are arranged together such that at least four containers are all connected together by said adhesive connecting structures, such that an open space is formed within the group of four containers and between said adhesive connecting structures, and said at least one carrier structure extends through said open space.

At least one other possible exemplary embodiment of the present application relates to the container multipack arrangement, wherein the containers are arranged in two rows, and at least one container of one of the two rows is adhesively connected to at least one container of the other row.

At least one possible exemplary embodiment of the present application relates to a method of packaging multipacks of containers comprising bottles, cans, and similar containers, which containers are configured to hold or contain a beverage, such as water, soft drinks, beer, wine, and juices, or a similar product for transport and consumption by consumers of beverages and similar products, said method of packaging multipacks of containers comprising: moving filled, closed containers to a container packaging machine; forming multipacks of filled, closed containers by arranging filled, closed containers in groups of at least four containers, then connecting or joining pairs of filled, closed containers to one another by applying a connecting structure to and between adjacent portions of the outer surfaces of pairs of filled, closed containers; forming and connecting a container multipack carrying arrangement to each multipack of filled, closed containers, either in said container packaging machine during formation of said multipacks or in a separate multipack handling machine after formation of said multipacks, which container multipack carrying arrangement is configured to permit manual carrying of a container multipack by a worker or consumer; and said step of forming and connecting said container multipack carrying arrangement comprising moving a base support structure of said container multipack carrying arrangement under the containers of each multipack and positioning at least one carrier structure of said container multipack carrying arrangement, which said at least one carrier structure is connected to said base support structure, to extend from said container base support structure over a height greater than or equal to the height of the containers of said container multipack, such that a projecting portion of said at least one carrier structure is disposed past the tops of the containers of said container multipack.

At least one other possible exemplary embodiment of the present application relates to the method of packaging multipacks of containers comprising bottles, cans, and similar containers, wherein said step of positioning said at least one carrier structure comprises positioning a portion of said at least one carrier structure to extend through at least one small space between the immediately adjacent outer surfaces of two containers of said container multipack not connected to one another by an adhesive connecting structure.

At least one other possible exemplary embodiment of the present application relates to the method of packaging multipacks of containers comprising bottles, cans, and similar containers, wherein said step of positioning said at least one carrier structure comprises positioning a portion of said at least one carrier structure to extend through an open space formed within a group of four containers and between said adhesive connecting structures.

Any numerical values disclosed herein, if any, should be understood as disclosing all approximate values within plus or minus ten percent of the numerical value. Any ranges of numerical values disclosed herein, if any, should be understood as disclosing all individual values within the range of values, including whole numbers, tenths of numbers, or hundredths of numbers.

The entirety of the appended drawings, including all dimensions, proportions, and/or shapes disclosed thereby or reasonably understood therefrom, are hereby incorporated by reference.

All of the patents, patent applications, patent publications, and other documents cited herein, are hereby incorporated by reference as if set forth in their entirety herein.

One example of a carrying element for multipacks, of which the containers are connected to one another in part sections at connecting locations, such as adhesively bonded, may possibly be found in DE 10 2011 107 264 A1, which discloses a carrying element which extends in the form of a disk between the containers, wherein the carrying element exhibits cut-out apertures into which the connecting locations are arranged. The locating of this carrying element requires an elaborate intervention in the production process of the multipack.

Further examples of carrying elements may possibly be disclosed by U.S. Pat. No. 2,677,460 or 3,106,289, each of which discloses carrying elements which are adhesively bonded to the containers. Here too, an adjustment of the method for producing the multipacks is required.

The corresponding foreign or international patent applications, as originally filed and as published, from which the present application claims the benefit of priority, are hereby incorporated by reference as if set forth in their entirety herein, as follows: PCT/EP2020/068205, WO2021008862, and DE102019119399.0.

The following patents, patent applications, patent publications, and other documents cited in the corresponding foreign or international patent applications listed in the preceding paragraph are hereby incorporated by reference as if set forth in their entirety herein, as follows: WO2013004337A1; DE102014104644A1; DE4429253A1; and EP0199336A2.

The following patents, patent applications, patent publications, and other documents are hereby incorporated by reference as if set forth in their entirety herein, as follows: U.S. Pat. Nos. 4,471,870A; 3,106,289A; 2,677,460A; 3,759,378A; 3,693,830A; and DE102011107264A1.

Although the invention has been described in detail for the purpose of illustration of any embodiments disclosed herein, including the most practical or preferred embodiments at the time of filing of this application, it is to be understood that such detail is solely for that purpose and that the invention is not limited to such embodiments, but, on the contrary, is intended to cover modifications and equivalent arrangements that are within the spirit and scope of the present application, including the specification and the claims as originally filed, as amended, or as issued. For example, it is to be understood that the present invention contemplates that, to the extent possible, one or more features or components of any disclosed embodiment can be combined with one or more features or components of any other disclosed embodiment.

What is claimed is:

1. A container multipack arrangement comprising:

a plurality of at least four containers arranged in a container multipack, with adjacent containers disposed in at least two rows each having two containers connected to one another in pairs by adhesive connecting structures adhesively adhering to mutually facing outer surfaces of said pairs of containers;

said containers being arranged relatively to one another to leave a space inside said multipack extending vertically from a bottom to a top of said multipack;

a container base support structure configured to be disposed under said containers of said container multipack;

said container base support structure being configured to support said container multipack thereon to permit transport or carrying of said container multipack, with said container base support structure vertically supporting said containers without embracing said containers or covering an outer surface of said containers; and at least one carrier structure connected to said container base support structure and configured to extend upward from said container base support structure through said space inside said multipack over a height greater than or equal to a height of said containers of said container multipack supported on said container base support structure, such that a projecting portion of said at least one carrier structure projects vertically past the top of said container multipack.

2. The container multipack arrangement according to claim 1, wherein said at least one carrier structure comprises one of (A), (B), or (C):

(A) a base end portion being connected to said container base support structure; and a body portion being configured and disposed to connect said base end portion to said projecting portion;

(B) two base end portions being connected to said container base support structure;

two body portions being configured and disposed to connect said base end portion to said projecting portion; and said projecting portion comprising an at least partially curved section being integrally formed with said two body portions to form a single structure;

(C) two base end portions being connected to said container base support structure; two body portions being configured and disposed to connect said base end portion to said projecting portion; and said projecting portion comprising two projecting portions being disposed one on each of said two body portions and being configured to be connected together.

3. The container multipack arrangement according to claim 2, wherein said at least one carrier structure is connected to said container base support structure at points by one or more connecting structures or by a continuous, elongated connecting structure.

4. The container multipack arrangement according to claim 3, wherein at least one of said container base support structure and said at least one carrier structure comprising a substantially flat material comprising at least one of: plastic, card, cardboard, and corrugated cardboard.

5. The container multipack arrangement according to claim 4, wherein one of (D) and (E):

(D) said at least one carrier structure and said container base support structure are configured as being one integral structure; and (E) said at least one carrier structure and said container base support structure are joined to one another by one of: a positive connection, a non-positive connection, or a material bond.

6. The container multipack arrangement according to claim 5, wherein said at least one carrier structure comprises a handle configured to permit manual carrying of the container multipack carrying arrangement.

7. The container multipack arrangement according to claim 6, wherein said at least one carrier structure comprises at least one weakened or pressed section configured to permit folding of at least one portion of said at least one carrier structure, either over another portion of said at least one carrier structure, over the tops of containers of a multipack, or with respect to said container base support structure.

8. The container multipack arrangement according to claim 7, wherein said container base support structure and said at least one carrier structure comprise the same material.

9. The container multipack arrangement according to claim 7, wherein said container base support structure and said at least one carrier structure comprise different materials.

10. The container multipack arrangement according to claim 1, wherein said at least one carrier structure is connected to at least one central portion of said container base support structure, which said at least one central portion is disposed such that, upon positioning of a container multipack on said container base support structure, said at least one carrier structure passes through at least one space between containers of the container multipack.

11. The container multipack arrangement according to claim 10, wherein said at least one carrier structure is configured to extend through said space between the immediately adjacent outer surfaces of two containers of a container multipack not connected to one another by an adhesive connecting structure.

12. The container multipack arrangement according to claim 10, wherein said at least one carrier structure is configured to extend through said space formed within a group of four containers and between adhesive connecting structures.

13. A container multipack arrangement comprising a multipack of containers configured to hold or contain a beverage, and a container multipack carrying arrangement being configured to permit carrying of said container multipack and comprising:

said container multipack including at least six containers arranged in three pairs of containers, including two outer pairs and one middle pair;

a container base support structure being disposed under the containers of said container multipack, which containers are connected together by adhesive connecting structures positioned between and connected to adjacent portions of the outer surfaces of pairs of containers, with said adhesive connecting structures being arranged in ring form around said container multipack of said at least six containers, but no adhesive connecting structure between said containers of said middle pair so as to leave a free space inside said container multipack extending from a bottom of said containers to a top thereof;

said container base support structure being configured and disposed to support the containers of said container multipack thereon to permit transport or carrying of the container multipack with said container multipack carrying arrangement; and at least one carrier structure being connected to said container base support structure and extending upward from said container base support structure through the free space inside said container multipack over a height greater than or equal to the height of the containers of a container multipack to be carried by said container multipack carrying arrangement, such that a projecting portion of said at least one carrier structure, upon said at least one carrier structure being positioned at a container multipack, is disposed past the tops of the containers of the container multipack.

14. The container multipack arrangement according to claim 13, wherein said at least one carrier structure extends through said free space between the immediately adjacent outer surfaces of two containers of said container multipack not connected to one another by an adhesive connecting structure.

15. The container multipack arrangement according to claim 14, wherein the containers are arranged in two rows, and at least one container of one of the two rows is adhesively connected to at least one container of the other row.

16. The container multipack arrangement according to claim 13, wherein said containers of said container multipack are arranged together such that at least four containers are all connected together by said adhesive connecting structures, such that said free space is formed within the group of four containers and between said adhesive connecting structures, and said at least one carrier structure extends through said free space.

17. The container multipack arrangement according to claim 16, wherein the containers are arranged in two rows, and at least one container of one of the two rows is adhesively connected to at least one container of the other row.

* * * * *